US008851917B2

(12) United States Patent
Chen

(10) Patent No.: US 8,851,917 B2
(45) Date of Patent: Oct. 7, 2014

(54) LOCKING MECHANISM HAVING A DRIVING COMPONENT FOR LOCKING AND UNLOCKING A PLUG TO A PLUG BASE

(75) Inventor: Zhou Chen, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/571,357

(22) Filed: Aug. 10, 2012

(65) Prior Publication Data

US 2013/0130531 A1 May 23, 2013

(30) Foreign Application Priority Data

Nov. 22, 2011 (CN) ..... 2011 1 0373446

(51) Int. Cl.

| | |
|---|---|
| ***H01R 13/625*** | (2006.01) |
| ***H01R 13/627*** | (2006.01) |
| ***H01R 13/639*** | (2006.01) |
| *H01R 27/00* | (2006.01) |
| *H01R 31/06* | (2006.01) |

(52) U.S. Cl.

CPC ..... *H01R 13/6275* (2013.01); *H01R 27/00* (2013.01); *H01R 31/06* (2013.01); *H01R 13/639* (2013.01)

USPC ..... 439/344

(58) Field of Classification Search

USPC ..... 439/344–358, 312, 152, 160, 372

See application file for complete search history.

(56) References Cited

U.S. PATENT DOCUMENTS

| | | | | |
|---|---|---|---|---|
| 4,913,667 | A * | 4/1990 | Muz | 439/733.1 |
| 5,252,082 | A * | 10/1993 | Hsieh et al. | 439/141 |
| 6,033,250 | A * | 3/2000 | Pauza | 439/357 |
| 6,080,004 | A * | 6/2000 | Kovacik et al. | 439/369 |
| 6,165,006 | A * | 12/2000 | Yeh et al. | 439/490 |
| 6,431,907 | B1 * | 8/2002 | Ma | 439/495 |
| 6,447,311 | B1 * | 9/2002 | Hu et al. | 439/108 |
| 6,699,050 | B1 * | 3/2004 | Wong et al. | 439/148 |
| 6,755,684 | B1 * | 6/2004 | Hueniken et al. | 439/532 |
| 6,994,580 | B1 * | 2/2006 | Chen | 439/344 |
| 7,232,349 | B1 * | 6/2007 | Chen | 439/810 |
| 7,632,132 | B2 * | 12/2009 | Nishio et al. | 439/357 |
| 8,109,778 | B2 * | 2/2012 | Howard et al. | 439/346 |
| 8,287,297 | B2 * | 10/2012 | Schmidt et al. | 439/345 |
| 8,453,973 | B2 * | 6/2013 | Costabel | 244/129.4 |
| 2008/0166922 | A1 * | 7/2008 | Goetze et al. | 439/660 |
| 2010/0303542 | A1 * | 12/2010 | Costabel | 403/326 |
| 2013/0183846 | A1 * | 7/2013 | Kappla et al. | 439/350 |

* cited by examiner

*Primary Examiner* — Chandrika Prasad

(74) *Attorney, Agent, or Firm* — Novak Druce Connolly Bove + Quigg LLP

(57) ABSTRACT

A plug device includes a plug base, a plug detachably mounted on the plug base, and a locking mechanism positioned on the plug base. The plug defines an engaging slot. The locking mechanism includes a latching component mounted on the plug base. When the latching component moves to an unlocking position, the latching component disengages from the engaging slot for allowing the plug being detached from the plug base. When the latching component moves to a locking position, the latching component is capable of being received in the engaging slot for locking the plug to the plug base.

8 Claims, 6 Drawing Sheets

LOCKING MECHANISM HAVING A DRIVING COMPONENT FOR LOCKING AND UNLOCKING A PLUG TO A PLUG BASE

BACKGROUND

1. Technical Field

The present disclosure relates to plug devices, and particularly, to a plug device having a locking mechanism.

2. Description of Related Art

Electronic devices usually include a plug that is inserted into a socket to connect to electric power. However, plugs have a fixed size (e.g., two-pin plug, three-pin plug), so it is only compatible for the sockets with a corresponding size, thereby decreasing the versatility of the plug.

Therefore, there is room for improvement in the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
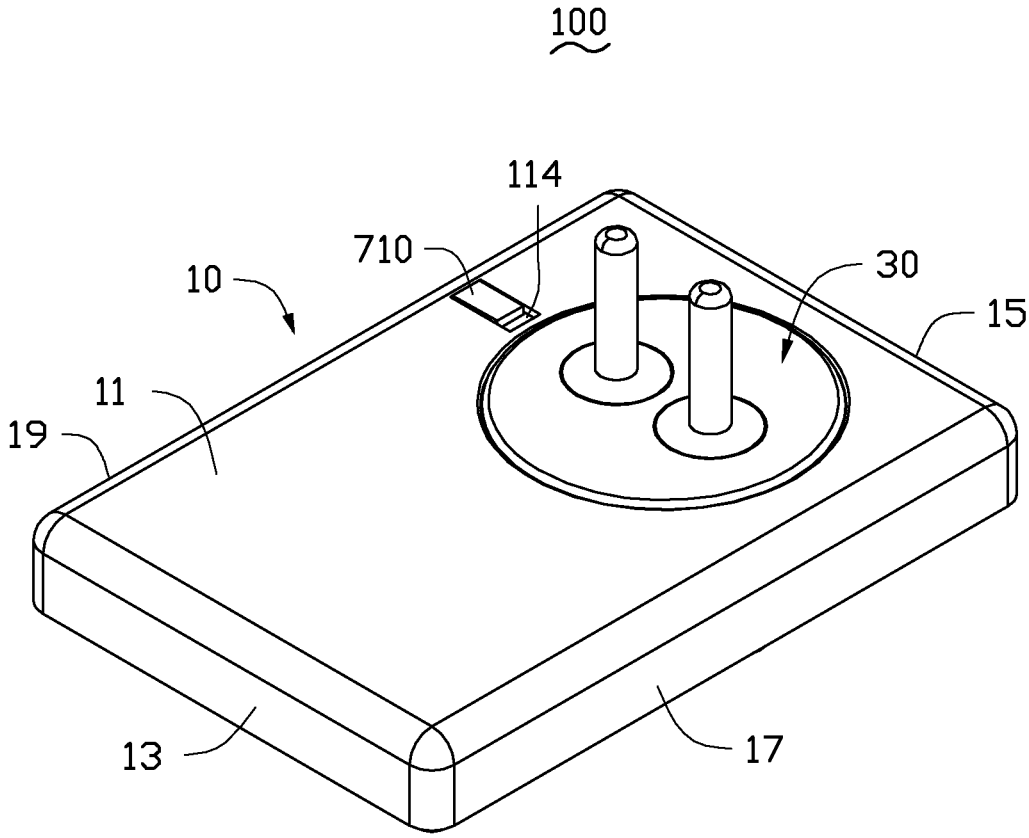
FIG. 1 is an isometric view of an embodiment of a plug device.
Figure 2:
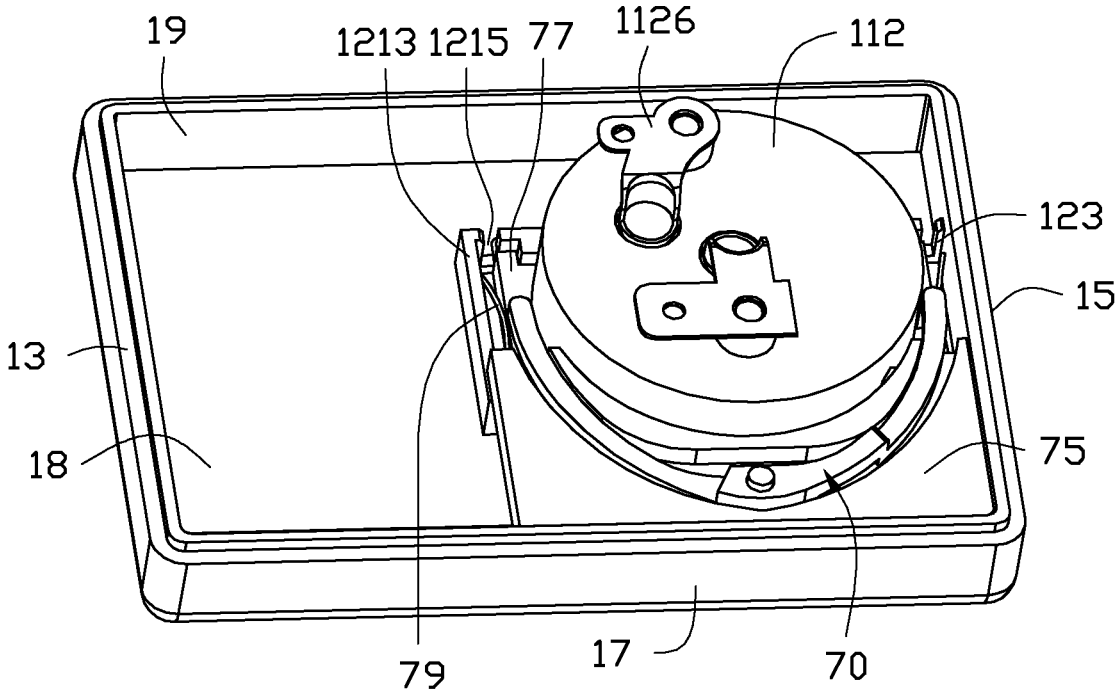
FIG. 2 is similar to FIG. 1, but viewed from another aspect.

Referring to FIGS. 1 and 2, a plug device 100 includes a base 10, a plug 30 detachable coupled to the base 10, and a locking mechanism 70. The locking mechanism 70 is used for securing the plug 30 to the base 10 and is used for allowing the plug 30 detaching from the base 10.

The plug base 10 includes a rectangle upper plate 11, a first sidewall 13, a second sidewall 15 opposite to the first sidewall 13, a third sidewall 17, and a fourth sidewall 19 opposite to the third sidewall 17. The first, second, third and fourth sidewalls 13, 15, 17, 19 perpendicularly extend from four rims of the upper plate 11 and are serially interconnect. The upper plate 11 cooperates with the first sidewall 13, the second sidewall 15, the third sidewall 17 and the fourth sidewall 19 to define a receiving space 18.

Figure 3:
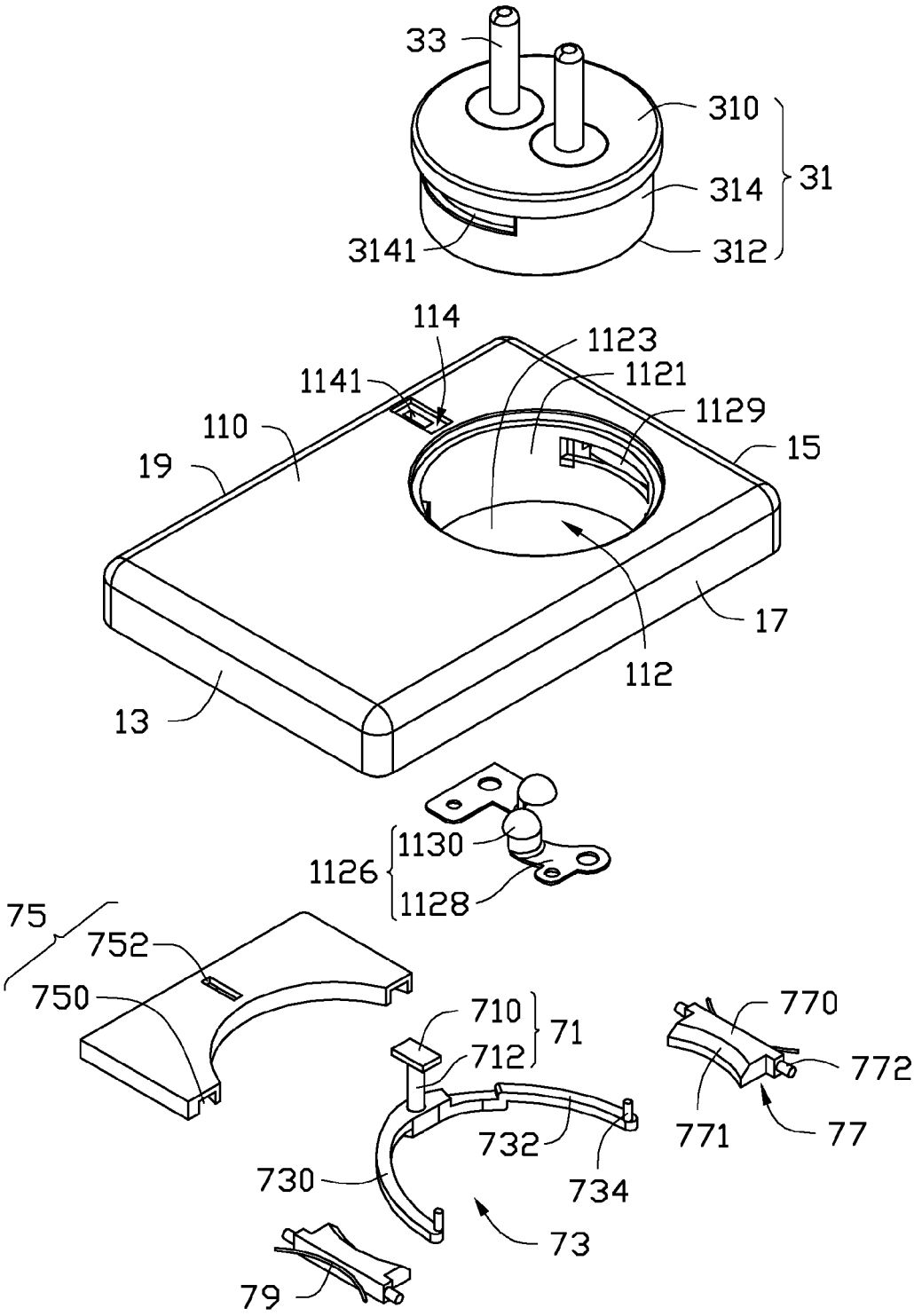
FIG. 3 is a partial, exploded view of the plug device of FIG. 1.
Figure 4:
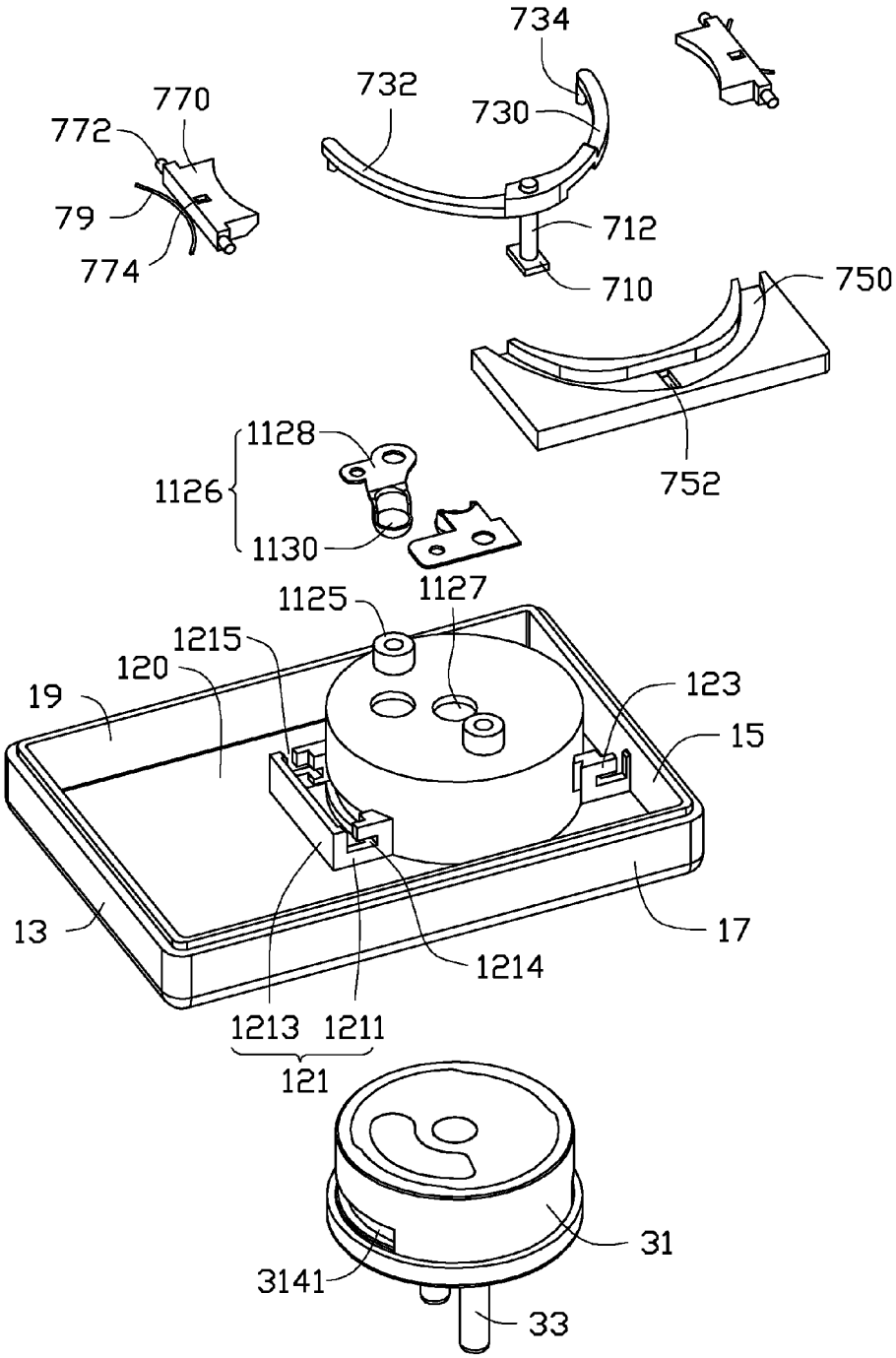
FIG. 4 is similar to FIG. 3, but viewed from another aspect.

Referring to FIGS. 3 and 4, the upper plate 11 includes an outer surface 110 and an inner surface 120 opposite to the outer surface 110. The outer surface 110 includes a receptacle portion 112 near the second sidewall 15 and a resisting portion 114. The resisting portion 114 is positioned between the receptacle portion 112 and the fourth sidewall 19.

The receptacle portion 112 is substantially hollow cylinder, and includes a fifth sidewall 1121 and a bottom wall 1123. When viewed from the outer surface 110 of the upper plate 11, the receptacle portion 112 is recessed in the outer surface 110; when viewed from the inner surface 120 of the upper plate 11, the receptacle portion 112 protrudes from the inner surface 120 and is received in the receiving space 18. The bottom wall 1123 is parallel to the outer surface 110, and the fifth sidewall 1121 is perpendicularly connected the outer surface 110 and the bottom wall 1123.

The fifth sidewall 1121 defines two opposite receiving grooves 1129. The two receiving grooves 1129 are substantially arc-shaped. The two receiving grooves 1129 are arranged symmetrically and are equidistant to the resisting portion 114. The bottom wall 1123 includes two spaced apart fixing posts 1125 and two conducting components 1126. The two fixing posts 1125 are substantially cylindrical, and protrude from a surface of the bottom wall 1123 opposite to the fifth sidewall 1121. The bottom wall 1123 defines two through holes 1127 between the two fixing posts 1125. Each conducting components 1126 is metal plates, and includes a connecting portion 1128 and a circular-shaped contacting portion 1130. The connecting portion 1128 is fixed to the corresponding fixing post 1125. The two contacting portions 1130 extend through the corresponding through hole 1127 and are received in the receptacle portion 112.

The resisting portion 114 is a rectangle recess defined at the outer surface 110. The middle of the bottom of the resisting portion 114 defines an engaging hole 1141. The engaging hole 1141 extends in a direction parallel to the second sidewall 15.

The inner surface 120 of the upper plate 11 includes a first sliding rail 121 and a second sliding rail 123. The first sliding rail 121 is positioned between the first sidewall 13 and the receptacle portion 112, and corresponds to the receiving groove 1129 near the first sidewall 13. The second sliding rail 123 is connected between the second sidewall 15 and the receptacle portion 112, and corresponds to the receiving groove 1129 near the second sidewall 15.

The first sliding rail 121 includes two spaced apart sliding walls 1211 and a preventing portion 1213. The preventing portion 1213 is substantially plate-shaped, and is parallel to the second sidewall 15. The receptacle portion 112 is located between the second sidewall 15 and the preventing portion 1213. The two sliding walls 1121 extend from opposite ends of the preventing portion 1213, and connect between the preventing portion 1213 and the fifth sidewall 1121. The corresponding receiving groove 1129 is positioned between the two sliding walls 1211. The middle portion of each sliding wall 1211 defines a sliding slot 1214. Each sliding slot 1214 extends along a direction parallel to the third sidewall 17. There is an opening 1215 defined at the boundary between the preventing portion 1213 and the corresponding end of the sliding wall 1211. The opening 1215 is communicated with the corresponding sliding slot 1214.

The second sliding rail 123 has the similar configuration to the first sliding rail 121. In the embodiment, two sliding walls 1211 of the second sliding rail 123 connect between the receptacle portion 112 and the second sidewall 15, thus the preventing portion 1213 is omitted.

The plug 30 is detachably received in the receptacle portion 112, and includes a main body 31 and two spaced apart pins 33. The shape of the main body 31 corresponds to the shape of the receptacle portion 112. The main body 31 includes a first end surface 310, a second end surface 312 opposite and parallel to the first end surface 310, a sixth sidewall 314, and two conducting plates (not shown). The sixth sidewall 314 connects between the first end surface 310 and the second end surface 312. The sixth sidewall 314 defines two latching slots 3141 corresponding to the two receiving grooves 1129 respectively. The two pins 33 are positioned on the first end surface 310 for electrically connecting with the external electric power. The two conducting plates are mounted on the second end surface 312 and correspond to the conducting components 1126, for allowing the plug 31 electrically connecting to the base 10.

The locking mechanism 70 is positioned on the plug base 10, and includes an operating component 71, a driving component 73, a fixing component 75, two latching components 77, and two elastic components 79.

The operating component 71 slidably connects to the upper plate 11, and includes an operating portion 710 and a connecting post 712. The operating portion 710 is received in the resisting portion 114 and is capable of being moved relative to the upper plate 11. The connecting post 712 is fixed to operating portion 710. The connecting post 712 extends through the engaging hole 1141 and exposes out of the inner surface 120 of the upper plate 11.

The driving component 73 connects an end of the connecting post 712 opposite to the operating portion 710. The driving component 73 includes a first driving arm 730, a second driving arm 732, and two positing posts 734. The first driving arm 730 and the second driving arm 732 are arc-shaped. Two corresponding ends of the first driving arm 730 and the second driving arm 732 connect to each other and cooperatively form a semicircle. An end of the connecting post 712 opposite to the operating portion 710 connects between the first driving arm 730 and the second driving arm 732. Thus, the first driving arm 730 and the second driving arm 732 are symmetrically opposite of each other relative to the connecting post 712. The positing posts 734 perpendicularly protrude from two ends of the first driving arm 730 and the second driving arm 732 away from the connecting post 712 respectively. The protruding directions of the two positing posts 734 are the same as the connecting post 712.

The fixing component 75 connects between the receptacle portion 112 and the third sidewall 17 and is received in the receiving space 18. The fixing component 75 defines a recess slot 750 and a mounting hole 752. The shape of the recess slot 750 corresponds to the shape of the driving component 73 and is configures for mating with the driving component 73. The mounting hole 752 is substantially rectangular-shaped, and is positioned in the middle of the bottom of the recess slot 750.

The two latching components 77 are slidably received in the corresponding receiving slot 1129. Each latching component 77 includes a body 770 and two sliding rods 772. The shape of the body 770 corresponds to the shape of the receiving groove 1129. An inclined surface 7701 is formed on a side of the body 770. The two sliding rods 772 are positioned on a side of the body 770 opposite to the inclined surface 7701 and extend from opposite ends of the corresponding side of the body 770. Each latching component 77 defines a positing hole 774 on a surface of the body 770 opposite to the inclined surface 7701.

The two elastic components 79 are arc-shaped. The two elastic components 79 are secured to an end of the body 770 opposite to the inclined surface 7701. Ends of the two elastic components 79 abut the preventing portion 1213 for providing an elastic force to drive the body 770 extending into the receptacle portion 112.

Figure 5:
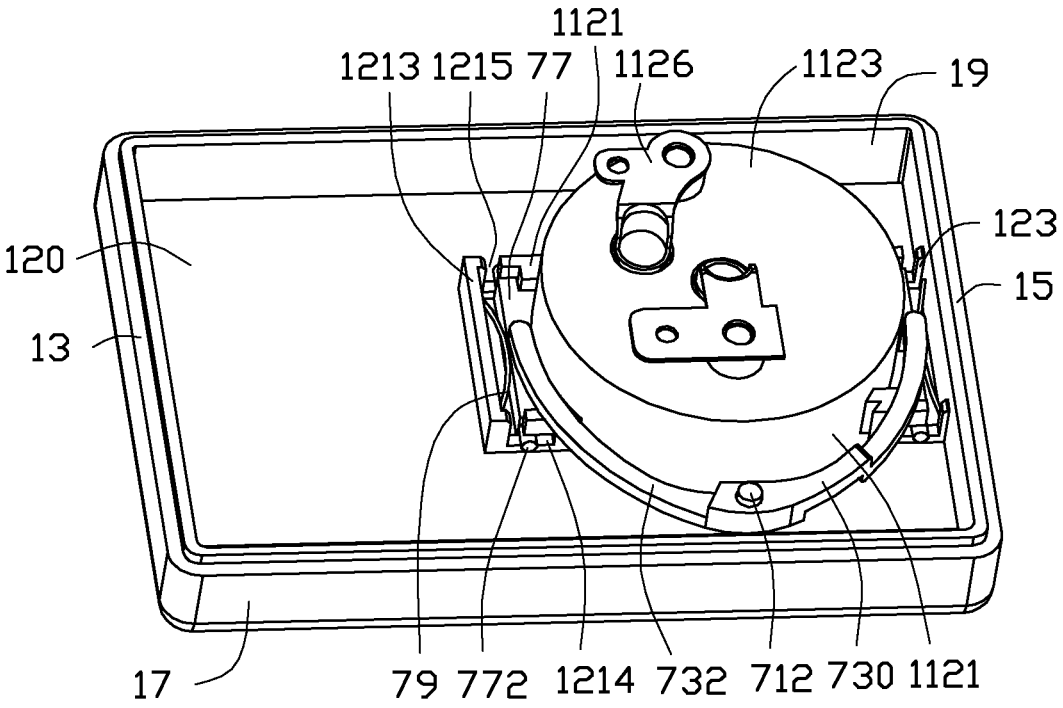
FIG. 5 is a partial, assembled view of the plug device of FIG. 4.
Figure 6:
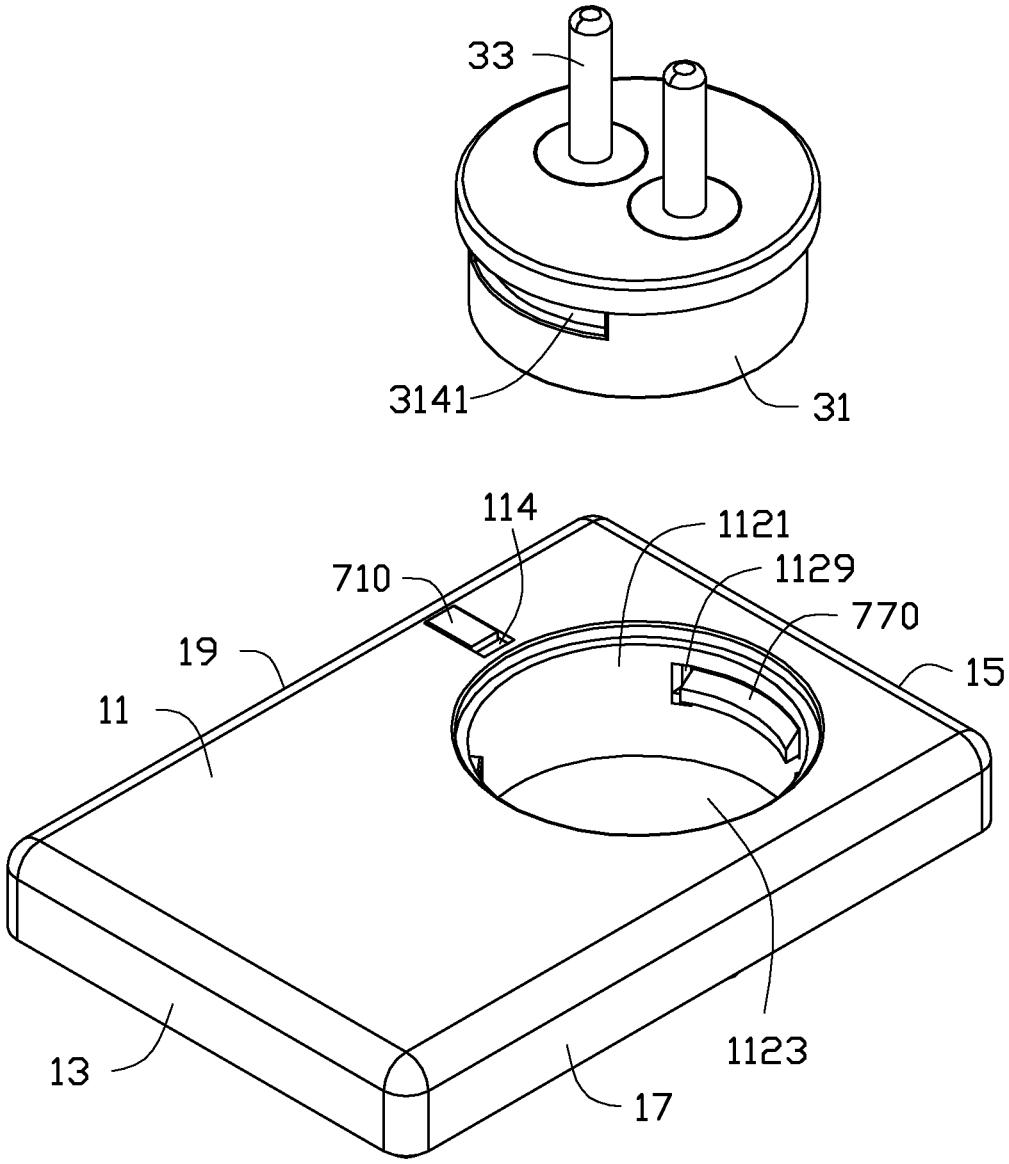
FIG. 6 is similar to FIG. 5, but viewed from another aspect.

Referring to FIGS. 5 and 6, in assembly, the two latching components 77 are received in the corresponding receiving groove 1129 with the positing holes 774 opposite to the upper plate 11 and the inclined surfaces 771 protruding out of the fifth sidewall 1121, for engaging with the corresponding engaging slot 3141 of the plug 30. The sliding rods 772 pass through the corresponding opening 1215 and are slidably received in the corresponding sliding slot 1214. The middle portion of each elastic component 79 resists an end of the latching component 77 opposite to the receiving groove 1129, the opposite ends of each elastic component 79 resist at the boundary of the corresponding preventing portion 1213 and sliding walls 1211.

Further referring to FIG. 2, the fixing component 75 is connected between the receptacle portion 112 and the third sidewall 17. The recess slot 750 is opposite to the upper plate 11 and is fitted around the receptacle portion 112. The driving component 73 is received in the recess slot 750 for restricting the movement of the first driving component 730 and the second driving component 732. The positing posts 734 are inserted into the corresponding positing hole 774 for securing the driving component 73 to the two latching components 77. An end of the connecting post 712 extends through the engaging hole 1141 and the mounting hole 752, and connects to the driving component 73. The operating portion 710 is received in the resisting portion 114.

To mount the plug 30 on the plug base 10 after initial assembly, the second end surface 312 resists the inclined surface 771, the engaging slots 3141 is aligned with corresponding inclined surface 7701 by rotation of the plug 30. The plug 30 is pressed down and pushes the latching components 77 to slide away from the receiving groove 1129 along the corresponding sliding slot 1214, for supplying a space to allow the plug 30 to receive in the receptacle portion 112. In this state, the elastic components 79 are compressed.

When the plug 30 is mounted in the receptacle portion 112, the two latching components 77 move toward the two receiving grooves 1129 respectively, and are latched into the two engaging slots 3141 respectively, by virtue of the elastic components 79. The operating portion 710 moves to an end of the resisting portion 114 away from the receptacle portion 112. As a result, the plug 30 is entirely combined with the plug base 10 rigidly and stably, the conducting plates of the plug 30 contact with the corresponding conducting component 50 for allowing the plug 30 to electrically connect to the plug base 10.

To detach the plug 30 from the plug base 10: an external force is applied to the operating portion 710 which pushes the operating portion to move toward the receptacle portion 112 in a first direction perpendicular to the fourth sidewall 19. The operating portion 710 drives the first driving arm 730 and the second driving arm 732 to rotate away from the receptacle portion 112 relative to the connecting post 712 in a second direction perpendicular to the first direction, to disengage the latching components 77 with the corresponding engaging slot 3141. When the latching components 77 are fully received in the corresponding receiving slots 1129, the latching components 77 detach from the corresponding engaging slot 3141. Thus, the plug 30 is capable of being taken away from the plug base 10. Finally, the elastic components 79 rebound to drive latching components 77 to receive in the receptacle portion 112 and expose out of the fifth sidewall 1121.

It is noteworthy that the position of the engaging slots 3141 and the locking mechanism 70 can be changed, for example, the engaging slots 3141 defined in the receptacle portion 112 of the plug, and the locking mechanism 70 may be mounted on the plug 30 corresponding to the engaging slots 3141.

Because the plug 30 is mounted on or detached from the plug base 10 easily and conveniently by pushing the operating portion 710, the plug 30 can be replaced rapidly. In addition, the plug 30 is secured on the plug base 10 by the locking mechanism 70, so that the plug 30 is exactly and stably combined with the plug base 10.

Although information and the advantages of the present embodiments have been set fourth in the foregoing description, together with details of the structures and functions of the present embodiments, the disclosure is illustrative only;

changes may be made in detail, especially in the matters of shape, size, and arrangement of parts within the principles of the present embodiments to the full extent indicated by the broad general meaning of the terms in which the appended claims are expressed.

What is claimed is:

1. A plug device, comprising:

a plug base;

a plug being detachably mounted on the plug base and symmetrically defining two engaging slots; and a locking mechanism positioned on the plug base for locking the plug to the plug base and unlocking the plug from the plug base, wherein the locking mechanism comprises:

two latching components symmetrically mounted on the plug base corresponding to the two engaging slots, the two latching components are capable of being moved between an unlocking position and a locking position;

wherein when the two latching components move to the unlocking position, the two latching components disengage from the corresponding two engaging slots for allowing the plug, being detached from the plug base; when the two latching components move to the locking position, the two latching components are latched into the two engaging slots respectively to clamp the plug for locking the plug to the plug base, the locking mechanism further comprises two elastic components connecting the corresponding two latching components with the plug base, when the two latching components move to the unlocking position, the two latching components move away from the plug and compress the corresponding elastic components for allowing the plug being detached from the plug base; when the two latching components move to the locking position, the two elastic components drive the corresponding two latching components to move toward the plug and receive in the corresponding two engaging slots for locking the plug to the plug base, the locking mechanism comprises a driving component, the two latching components connect to the driving component, and the driving component is capable of driving the two latching components to move for allowing the plug to mount on and detach from the plug base, the locking mechanism comprises an operating component connected to the driving component, the operating component is capable of moving the driving component and the two latching components for allowing the plug to mount on and detach from the plug base, the operating component comprises an operating portion and a connecting post connected to the operating portion, the plug base comprises a resisting portion defined a through hole, the operating portion is received in the resisting portion and capable of moving in a first direction toward to the plug, the connecting post extends through the through hole and connects between the operating portion and the driving component, the connecting post and the two latching components connect opposite ends of the driving component, when the operating portion moves in the first direction, the driving component rotates to drive the two latching components to move in a second direction different from the first direction for allowing the plug to mount on and detach from the plug base, the driving component is arched, and the connecting post is positioned in the middle portion of the driving component.

2. The plug device as claimed in claim 1, wherein the plug base comprises an outer surface, and an inner surface opposite to the outer surface, a receptacle portion positioned on the outer surface for receiving the plug, the receptacle portion defines two receiving grooves, the two latching components are capable of being received in and exposing our of the corresponding receiving groove.

3. The plug device as claimed in claim 2, wherein the plug base comprises two pairs of opposite sliding walls, the corresponding two receiving grooves are positioned between each pair of sliding walls; each sliding wall defines two sliding slots, each of the latching components comprises two sliding rods corresponding to the two sliding slots for allowing the corresponding latching components to slidably receive in the corresponding receiving grooves.

4. The plug device as claimed in claim 3, wherein the plug base further comprises two preventing portions, each preventing portion connects between the corresponding two sliding walls and opposite to one of the corresponding receiving grooves, the corresponding elastic components resist between the corresponding latching components and the preventing portions.

5. A locking mechanism for locking a ping to a ping base and unlocking the plug from the plug base, the plug symmetrically defining two engaging slots, the locking mechanism comprising:

two latching components symmetrically mounted on the plug base corresponding to the two engaging slots, the two latching components capable of being moved between an unlocking position and a locking position;

wherein when the two latching components move to the unlocking position, the two latching components disengage from the corresponding two engaging slots for allowing the plug being detached from the plug base; when the two latching components move to the locking position, the two latching components are latched into the two engaging slots respectively to clamp the plug for locking the plug to the plug base, the locking mechanism further comprises two elastic components connecting the corresponding two latching components with the plug base, when the two latching components move to the unlocking position, the two latching components move away from the plug and compress the corresponding elastic components for allowing the plug being detached from the pine base; when the two latching components move to the locking position, the two elastic components drive the corresponding two latching, components to move toward the plug and receive in the corresponding two engaging slots for locking the plug to the plug base, the locking mechanism comprises a driving component, the two latching components connect to the driving component, and the driving component is capable of driving the two latching components to move for allowing the plan to mount on and detach from the plan base, the locking mechanism comprises an operating component connected to the driving component, the operating component is capable of moving the driving component and the two latching components for allowing the plug to mount on and detach from the plug base, the operating component comprises an operating portion and a connecting post connected to the operating portion, the plug base comprises a resisting portion defined a through hole, the operating portion is received in the resisting portion and capable of moving in a first direction toward to the plug, the connecting post extends through the through hole and connects between the operating portion and the driving component, the connecting post and the two latching components connect opposite ends of the driving component, when the operating portion moves in the first direction, the driving component rotates to drive the two latching components to move in a second direction different from the first direction for allowing the plug to mount on and detach from the plug base, the driving component is arched, and the connecting post is positioned in the middle portion of the driving component.

6. The plug device as claimed in claim 5, wherein the plug base comprises an outer surface, and an inner surface opposite to the outer surface, a receptacle portion positioned on the outer surface for receiving the plug, the receptacle portion defines two receiving grooves, the two latching components are capable of being received in and exposing out of the corresponding receiving groove.

7. The plug device as claimed in claim 6, wherein the plug base comprises two pairs of opposite sliding walls, the corresponding two receiving grooves are positioned between each pair of sliding walls; each sliding wall defines two sliding slots, each of the latching components comprises two sliding rods corresponding to the two sliding slots for allowing the corresponding latching components to slidably receive in the corresponding receiving grooves.

8. The plug device as claimed in claim 7, wherein the plug base further comprises two preventing portions, each preventing portion connects between the corresponding two sliding walls and opposite to one of the corresponding receiving grooves, the corresponding elastic components resist between the corresponding latching components and the preventing portions.

* * * * *